US009932163B2

(12) United States Patent
Nishijima

(10) Patent No.: US 9,932,163 B2
(45) Date of Patent: Apr. 3, 2018

(54) PACKAGING STRUCTURE FOR COOKING DEVICE

(71) Applicant: Sharp Kabushiki Kaisha, Sakai-shi, Osaka (JP)

(72) Inventor: Masahiro Nishijima, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 17 days.

(21) Appl. No.: 15/118,938

(22) PCT Filed: Aug. 21, 2015

(86) PCT No.: PCT/JP2015/073586

§ 371 (c)(1),
(2) Date: Aug. 15, 2016

(87) PCT Pub. No.: WO2016/035583

PCT Pub. Date: Mar. 10, 2016

(65) Prior Publication Data

US 2016/0355317 A1 Dec. 8, 2016

(30) Foreign Application Priority Data

Sep. 1, 2014 (JP) ..... 2014-177074

(51) Int. Cl.
*B65D 81/127* (2006.01)
*H05B 6/64* (2006.01)
(Continued)

(52) U.S. Cl.
CPC ..... *B65D 81/127* (2013.01); *B65D 5/505* (2013.01); *B65D 5/5052* (2013.01); *B65D 81/05* (2013.01);
(Continued)

(58) Field of Classification Search
CPC .... B65D 5/5052; B65D 85/68; B65D 81/127; B65D 5/505; B65D 81/05; F24C 7/10; H05B 6/6402
(Continued)

(56) References Cited

U.S. PATENT DOCUMENTS 1,392,791 A * 10/1921 Pettee ..... B65D 59/04 206/586
2,177,241 A * 10/1939 Burack ..... B65D 5/505 206/454
(Continued)

FOREIGN PATENT DOCUMENTS

JP 4818204 B2 11/2011

*Primary Examiner* — Chun Cheung
(74) *Attorney, Agent, or Firm* — Keating & Bennett, LLP

(57) ABSTRACT

A packaging structure for a cooking device is so configured that a packaging material (101) with trays (91, 92) packaged therewith is disposed in a heating chamber (2) with such an inclination that a one-side portion of the packaging material (101) becomes higher than the other-side portion of the packaging material (101). Also, the one-side portion of the packaging material (101) is placed on a one-side-portion side tray holder (16A). Further, a cushioning material (201) is inserted between an upper portion (2*e*) of the heating chamber (2) and the one-side portion of the packaging material (101), so that the one-side portion of the packaging material (101) is pressed against the one-side-portion side tray holder (16A) while the other-side portion of the packaging material (101) is pressed against the other-side-portion side inner side surface (2*c*) of the chamber.

10 Claims, 12 Drawing Sheets

(51) Int. Cl.

| | |
|---|---|
| ***B65D 85/68*** | (2006.01) |
| ***F24C 7/10*** | (2006.01) |
| ***B65D 81/05*** | (2006.01) |
| ***B65D 5/50*** | (2006.01) |
| *F24C 15/16* | (2006.01) |

(52) U.S. Cl.
CPC ..... *B65D 85/68* (2013.01); *F24C 7/10* (2013.01); *H05B 6/6402* (2013.01); *B65D 2585/682* (2013.01); *F24C 15/16* (2013.01)

(58) Field of Classification Search
USPC ..... 206/320, 521–594
See application file for complete search history.

(56) References Cited

U.S. PATENT DOCUMENTS

| | | | | | |
|---|---|---|---|---|---|
| 2,651,448 | A * | 9/1953 | Dusseault | B65D 5/5095 | 206/335 |
| 5,005,705 | A * | 4/1991 | Combs | B65D 5/5045 | 206/419 |
| 5,786,580 | A * | 7/1998 | Yeo | B65D 5/5035 | 206/583 |
| 5,873,459 | A * | 2/1999 | Yeo | B65D 75/14 | 206/320 |
| 2011/0084066 | A1 * | 4/2011 | Gibson | H05B 6/6408 | 219/762 |

* cited by examiner

PACKAGING STRUCTURE FOR COOKING DEVICE

TECHNICAL FIELD

The present invention relates to a packaging structure for cooking devices.

BACKGROUND ART

Among conventional packaging structures for cooking devices is one disclosed in JP 4818204 A (PTL1). In this packaging structure, a tray is set on a base member, a grid is set on the tray, and further a cushioning material is set on the grid. Then, the tray, the grid and the cushioning material are put into a heating chamber along with the base member. In this case, the grid and the base member are in contact with the tray.

The grid, when put into the heating chamber, is elastically deformed so that the cushioning material is prevented from catching on an opening of the heating chamber.

By the setting that the base member, the tray, the grid and the cushioning material are put into the heating chamber as described above, the tray is pressed against the base member by elasticity of the grid in the heating chamber, with the intention of restricting motions of the tray during the transportation.

CITATION LIST

Patent Literature

PTL1: JP 4818204 A

SUMMARY OF INVENTION

Technical Problem

With the above-described conventional packaging structure for cooking devices, it may occur that because of failing to obtain a desired elasticity of the grid due to manufacturing errors, the grid becomes weaker in elasticity so that the tray cannot be pressed against the base member.

As a result, the conventional packaging structure for cooking devices has had a problem that the tray may largely rattle during the transportation.

The conventional packaging structure for cooking devices has another problem that because the grid and the base member are in contact with the tray, the tray may wear due to shocks during the transportation.

Accordingly, an object of the present invention is to provide a packaging structure for cooking devices capable of lowering the possibility of the tray's rattling during the transportation and moreover preventing the tray's wear during the transportation.

Solution to Problem

In order to solve the problem, a cooking-device packaging structure for use with a cooking device according to the present invention including: a heating chamber having on a front side an opening in which a heating object to be heated is accommodated; a tray for mounting the heating object thereon; and a tray holder provided on an inner side surface of the heating chamber to hold the tray, the cooking-device packaging structure comprising:

a box-shaped packaging material for packaging the tray; and a cushioning material, wherein the packaging material with the tray packaged therewith is disposed in the heating chamber with such an inclination that a one-side portion of the packaging material becomes higher than the other-side portion of the packaging material, the one-side portion of the packaging material is placed on the one-side portion side tray holder, and the cushioning material is inserted between an upper portion of the heating chamber and the one-side portion of the packaging material so that the one-side portion of the packaging material is pressed against the one-side-portion side tray holder while the other-side portion of the packaging material is pressed against the other-side-portion side inner side surface of the heating chamber.

In the cooking-device packaging structure of one embodiment, a chamfered surface with which part of the cushioning material is to be put into contact is provided at an upper-side corner portion of the one-side portion of the packaging material.

In the cooking-device packaging structure of one embodiment, the tray has a bottom portion, a wall portion erectly provided at peripheral edge portion of the bottom portion, and a flange portion that stretches outward in adjacency to an end portion of the wall portion on one side opposite to a bottom portion side, the bottom portion being packaged with the packaging material so that the bottom portion is opposed to an upper portion of the heating chamber, and the chamfered surface is positioned near a plane which is in contact with the one-side-portion side end of the bottom portion of the cooking tray as well as in contact with the one-side-portion side end of the flange portion of the cooking tray.

In the cooking-device packaging structure of one embodiment, the cushioning material has such a generally triangular-shaped cross section that its top portion is in contact with an upper portion of the heating chamber while its bottom portion is in contact with the chamfered surface.

In the cooking-device packaging structure of one embodiment, the cushioning material has an engagement portion which is placed between the one-side portion of the packaging material and the one-side-portion side inner side surface of the chamber and which is to be engaged with at least one of the one-side portion of the packaging material and the one-side-portion side inner side surface of the chamber.

In the cooking-device packaging structure of one embodiment, the packaging material has a positioning portion which is provided rearward of a front-rear center of the packaging material and which is to be put into contact with a rear end portion of the cushioning material.

In the cooking-device packaging structure of one embodiment, the other-side portion of the packaging material is placed between the other-side-portion side tray holder and the bottom portion of the heating chamber.

In the cooking-device packaging structure of one embodiment, a chamfered surface with which the other-side-portion side tray holder is to be put into contact is provided at an upper-side corner portion of the other-side portion of the packaging material.

In the cooking-device packaging structure of one embodiment, a pair of first cut-and-raises pivotable along a plane parallel to an insertional direction of the packaging material into the heating chamber as well as a pair of mutually engageable second cut-and-raises are provided in a top surface of the packaging material, and a water supply tank to be used for the cooking device is sandwiched by the first cut-and-raises while the water supply tank is held by the mutually engaged second cut-and-raises.

In the cooking-device packaging structure of one embodiment, the water supply tank is sandwiched by the first cut-and-raises and moreover held by the mutually engaged second cut-and-raises so as to be positioned on a deeper side in the heating chamber when the packaging material is inserted into the heating chamber.

Advantageous Effects of Invention

According to the cooking-device packaging structure of the invention, a one-side portion of a box-shaped packaging material with trays packaged therewith is pressed against the one-side-portion side tray holder while the other-side portion of the packaging material is pressed against the other-side-portion side inner side surface of the heating chamber. Thus, the likelihood that the trays may largely rattle during the transportation can be lowered, and moreover wear of the trays during the transportation can be prevented.

DESCRIPTION OF EMBODIMENTS

Hereinbelow, a cooking device according to the present invention will be described in detail by embodiments thereof illustrated in the accompanying drawings. In the following description, the term 'left side' refers to a left-hand side of a viewer facing the cooking device as the cooking device is viewed from its door side, and the term 'right side' refers to a right-hand side of a viewer facing the cooking device as the cooking device is viewed from its door side.

Figure 1:
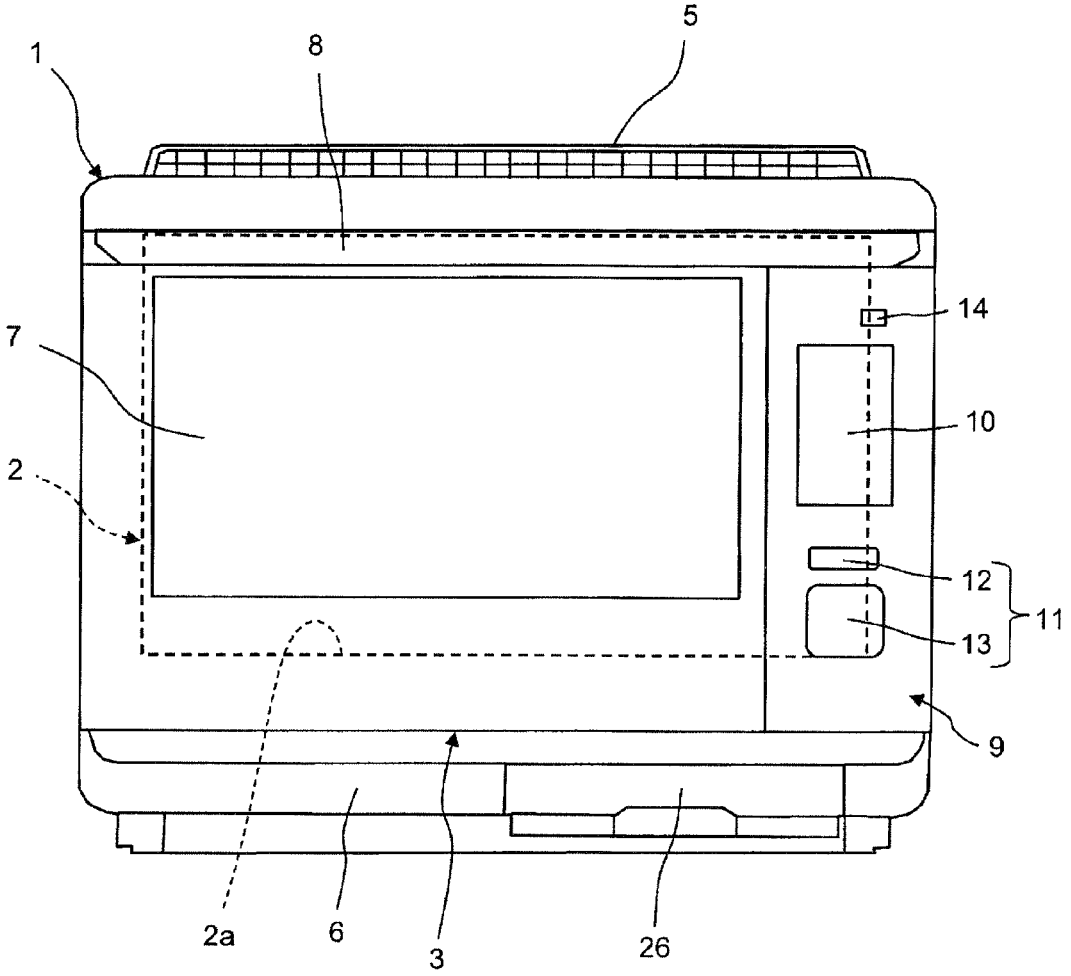
FIG. 1 is a schematic front view of a cooking device, with its door closed, of a cooking-device packaging structure according to one embodiment of the invention.
Figure 2:
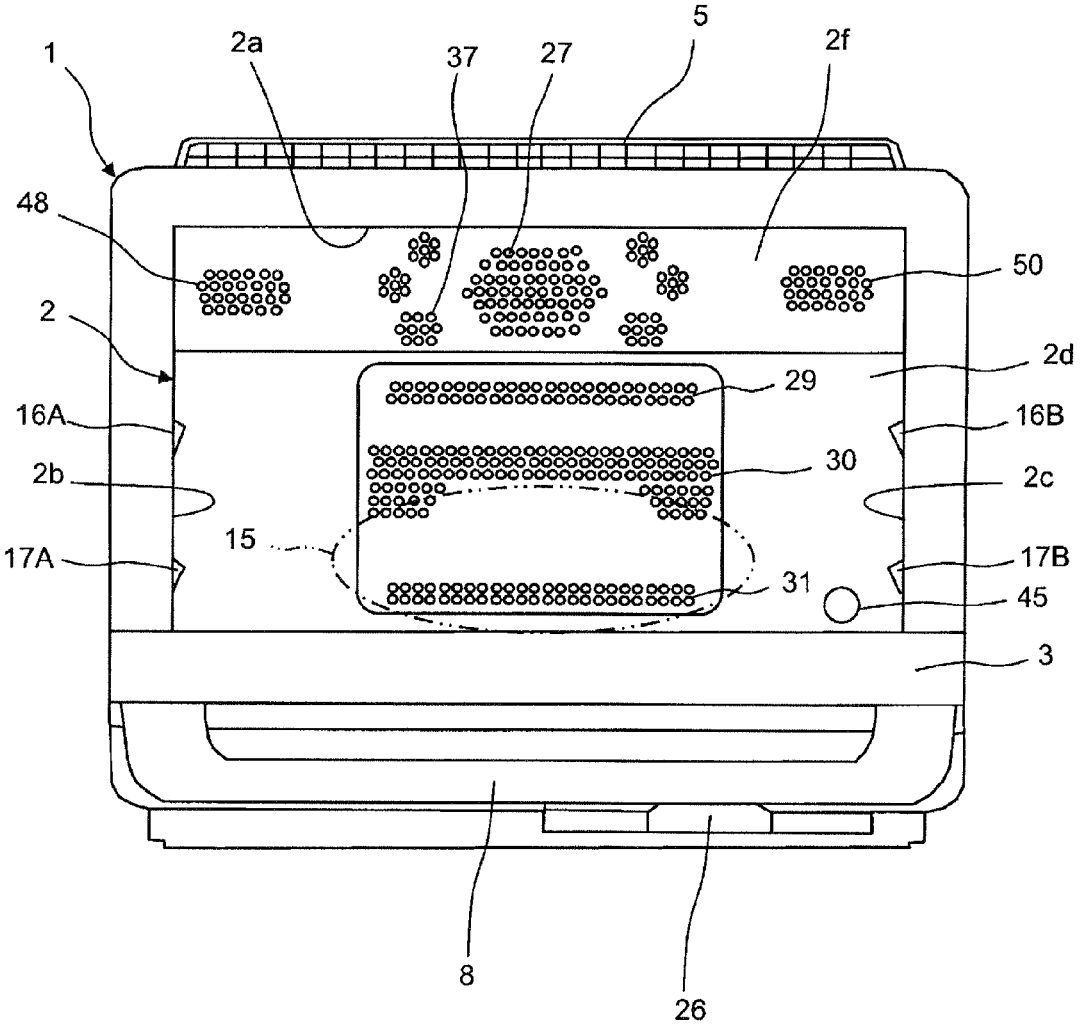
FIG. 2 is a schematic front view of the cooking device with its door opened.

FIG. 1 is a schematic front view of a cooking device, with its door closed, of a cooking-device packaging structure according to one embodiment of the invention. FIG. 2 is a schematic front view of the cooking device with its door opened.

As shown in FIGS. 1 and 2, the cooking device includes a rectangular parallelepiped-shaped casing 1, a heating chamber 2 provided in the casing 1 and having on its front side an opening 2*a* for accommodating therein a heating object 15 to be heated, a door 3 for opening and closing the opening 2*a* of the heating chamber 2, and a magnetron 4 (shown in FIG. 5) for radiating microwaves into the heating chamber 2.

An exhaust duct 5 is provided in rear portion of a top surface of the casing 1. A dew receiving container 6 is removably attached in a lower front of the casing 1. The dew receiving container 6, located below the door 3, is enabled to receive water droplets derived from a back face (heating chamber 2-side surface) of the door 3. A later-described water supply tank 26 is also removably attached in the lower front of the casing 1.

The door 3 has a lower portion pivotably attached in the front face of the casing 1. A transparent outer glass 7 having thermal resistance is provided in a front face (a surface opposite to the heating chamber 2-side surface) of the door 3. The door 3 also has a handle 8 positioned above the outer glass 7, and an operation panel 9 provided on a right side of the outer glass 7.

The operation panel 9 has a color LCD (Liquid Crystal Display) part 10 and a button group 11. The button group 11 includes a cancel key 12 to be pressed for halfway stop of heating or other occasions, and a heating start key 13 to be pressed for a start of heating. In the operation panel 9, an infrared ray receiving part 14 for receiving an infrared ray derived from a smartphone or the like is provided.

A heating object 15, which is to be heated, is accommodated in the heating chamber 2. Metallic cooking trays 91, 92 (shown in FIG. 3) can be put into and out of the heating chamber 2. These cooking trays 91, 92 respectively have bottom portions 91*a*, 92*a*, wall portions 91*b*, 92*b* erectly provided at peripheral edge portions of the bottom portions 91*a*, 92*a*, and flange portions 91*c*, 92*c* that stretch outward in adjacency to end portions of the wall portions 91*b*, 92*b* on one side opposite to the bottom portions 91*a*, 92*a* side. The heating object 15 is to be set directly on the bottom portions 91*a*, 92*a* or set thereon with cooking grids 93, 94 (shown in FIG. 7) interposed therebetween, respectively.

On a left-side inner side surface 2*b* of the heating chamber 2, provided are a first upper tray holder 16A, and a first lower tray holder 17A positioned below the first upper tray holder 16A. Meanwhile, on a right-side inner side surface 2*c* of the heating chamber 2, provided are a second upper tray holder 16B, and a second lower tray holder 17B positioned below the second upper tray holder 16B. The first, second upper tray holders 16A, 16B engageably and disengageably hold a left end portion and a right end portion, respectively, of the flange portion 91*c* of the cooking tray 91. Meanwhile, the first, second lower tray holders 17A, 17B engageably and disengageably hold a left end portion and a right end portion, respectively, of the flange portion 91*c* of the cooking tray 92, so that the cooking tray 92 is positioned below the cooking tray 91. In addition, the cooking trays 91, 92 are each one example of the tray. The first upper tray holder 16A and the second lower tray holder 17B is each one example of the tray holder.

The cooking trays 91, 92, when set in the heating chamber 2, have gaps between front end portions of the flange portions 91*c*, 92*c*, respectively, and the door 3 as well as gaps between rear end portions of the flange portions 91*c*, 92*c*, respectively, and a rear portion 2*d* of the heating chamber 2. More specifically, provided in the rear portion 2*d* of the heating chamber 2 are two protrusions (not shown) to be put into contact with the rear end portion of the flange portion 91*c* of the cooking tray 91 as well as two protrusions (not shown) to be put into contact with the rear end portion of the flange portion 92*c* of the cooking tray 92. As a result of this, when the cooking trays 91, 92 are put into the heating chamber 2 and then pushed depthward, the rear end portions of the flange portions 91*c*, 92*c* of the cooking trays 91, 92 are brought into contact with the protrusions. Thus, gaps are formed between the rear end portions of the flange portions 91*c*, 92*c* of the cooking trays 91, 92, respectively, and the rear portion 2*d* of the heating chamber 2. The front-and-rear length of each gap is, for example, 3 mm.

Figure 3:
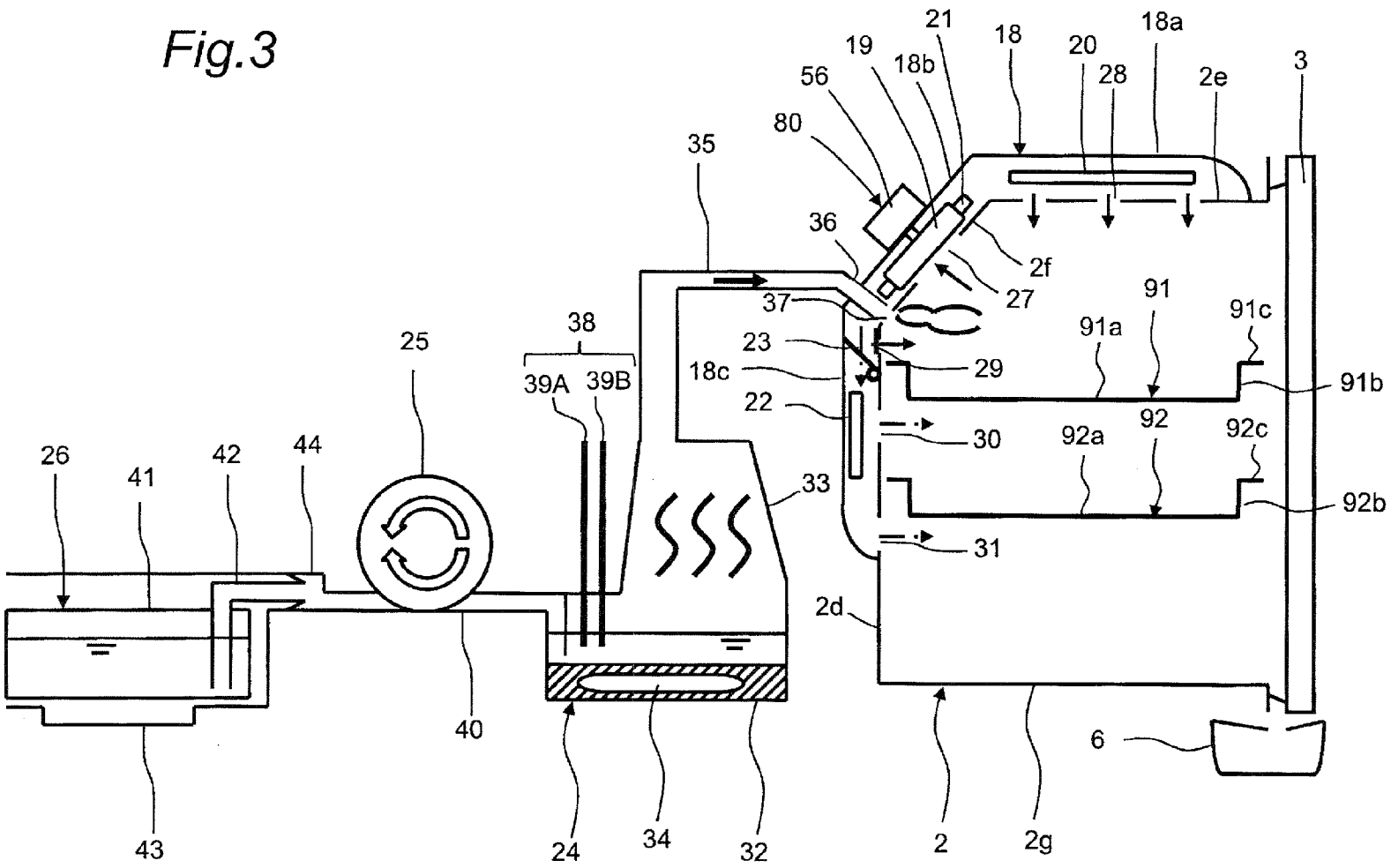
FIG. 3 is a schematic view for explaining a main part of the cooking device.

FIG. 3 is a schematic view for explaining a main-part structure of the cooking device. In this FIG. 3, the heating chamber 2 is shown as viewed from the left side.

The cooking device includes a circulation duct 18, an upper heater 20, a middle heater 21, a lower heater 22, a circulation damper 23, a steam generator 24, a tube pump 25, and a water supply tank 26. These upper heater 20, middle heater 21 and lower heater 22 are provided each as a sheath heater, for example.

An upper portion 2*e* of the heating chamber 2 continues to the rear portion 2*d* of the heating chamber 2 via a sloped portion 2*f* sloped relative to a horizontal direction. In the sloped portion 2*f*, a plurality of suction ports 27 are provided so as to be opposed to the circulation fan 19. A plurality of upper blowoff ports 28 are provided in the upper portion 2*e* of the heating chamber 2. First rear blowoff ports 29, second rear blowoff ports 30 and third rear blowoff ports 31 are provided, each in plurality, in the rear portion 2*d* of the heating chamber 2. In addition, the upper blowoff ports 28 are depicted only three in number in FIG. 3. The suction ports 27, the first rear blowoff ports 29, the second rear blowoff ports 30 and the third rear blowoff ports 31 are depicted each only one in number in FIG. 3.

The circulation duct 18, being metallic, is provided outside the heating chamber 2 so as to be communicated with inside of the heating chamber 2 via the suction ports 27, the upper blowoff ports 28 and the first to third rear blowoff ports 29 to 31. The circulation duct 18 is provided so as to range from upper side to rear side of the heating chamber 2 and extend in an inverted-L like shape. More specifically, the circulation duct 18 is composed of a front portion 18*a* which is opposed to the upper portion 2*e* of the heating chamber 2, a connecting portion 18*b* which extends obliquely downward in adjacency to a rear end of the upper portion 2*e* and which is opposed to the sloped portion 2*f* of the heating chamber 2, and a rear portion 18*c* which extends directly downward in adjacency to a lower end of the connecting portion 18*b* and which is opposed to the rear portion 2*d* of the heating chamber 2. The circulation duct 18 has a left-right width set narrower than a left-right width of the heating chamber 2.

A circulation fan unit 80 includes the circulation fan 19, and a circulation fan motor 56 provided as, e.g., a DC motor to drive the circulation fan 19. The circulation fan unit 80 is removably attached to the circulation duct 18 so as to be opposed to the sloped portion 2*f* of the heating chamber 2.

The circulation fan 19 is placed in the circulation duct 18 so as to be opposed to the sloped portion 2*f*. More specifically, the circulation fan 19, provided as a forward-and-reverse rotatable centrifugal fan, is placed in the connecting portion 18*b* of the circulation duct 18. As the circulation fan 19 is rotated, air and saturated steam and the like (hereinafter, referred to as 'air and the like') within the heating chamber 2 are sucked through the suction ports 27 into the circulation duct 18, then let to flow radially outward of the circulation fan 19. More specifically, on the upper side of the circulation fan 19, air and the like are let to flow obliquely upward from the circulation fan 19 and then flow from rear toward front. On the lower side of the circulation fan 19, on the other hand, air and the like are let to flow obliquely downward from the circulation fan 19 and then flow from above toward below. That is, the circulation fan 19 feeds air and the like to the upper heater 20, the middle heater 21 and the lower heater 22.

The upper heater 20 is placed within the front portion 18*a* of the circulation duct 18 and opposed to the upper portion 2*e* of the heating chamber 2. The upper heater 20 heats air and the like flowing to the upper blowoff ports 28.

The middle heater 21 is formed into such an annular shape as to surround the circulation fan 19. The middle heater 21 heats air and the like flowing from the circulation fan 19 toward the upper heater 20 or heats air and the like flowing from the circulation fan 19 toward the lower heater 22.

The lower heater 22 is placed within the rear portion 18*c* of the circulation duct 18 and opposed to the rear portion 2*d* of the heating chamber 2. The lower heater 22 heats air and the like flowing to the second, third rear blowoff ports 30, 31.

The circulation damper 23 opens and closes the first rear blowoff ports 29. More specifically, the circulation damper 23 is pivotably provided within the circulation duct 18 and positioned between the middle heater 21 and the lower heater 22. Pivoting of the circulation damper 23 is performed by a circulation damper motor 59 (shown in FIG. 5). Pivoting of the circulation damper 23 causes the first rear blowoff ports 29 to be opened and closed.

The circulation damper 23, when having opened the first rear blowoff ports 29, closes a range between the circulation fan 19 and the second rear blowoff ports 30. As a result of this, the first rear blowoff ports 29 are allowed to blow off air and the like heated by the middle heater 21 into the heating chamber 2, whereas the second, third rear blowoff ports 30, 31 are no longer allowed to blow off air and the like heated by the middle heater 21 into the heating chamber 2.

The circulation damper 23, when having closed the first rear blowoff ports 29, opens the range between the circulation fan 19 and the second rear blowoff ports 30. As a result of this, the first to third rear blowoff ports 29 to 31 are allowed to blow off air and the like heated by the middle heater 21 into the heating chamber 2.

The first rear blowoff ports 29 are positioned above the gap between the cooking tray 91 and the rear portion 2*d* of the heating chamber 2 and moreover near the rear portion of the cooking tray 91. The inside of the heating chamber 2 is communicated with inside of the rear portion 18*c* of the circulation duct 18 via the first rear blowoff ports 29.

The steam generator 24 includes a metallic container 32 having an upper-end opening, a resin-made lid 33 for closing the opening, and a steam-generating heater cast into a bottom portion of the container 32 and provided as a sheath heater. Water derived from the water supply tank 26 accumulates on the bottom portion of the container 32, and the water is heated by the steam-generating heater 34 via the bottom portion of the container 32. Saturated steam generated by this heating flows through a resin-made steam tube 35 and a metallic steam tube 36 so as to be supplied into the connecting portion 18*b* of the circulation duct 18. In this case, with the circulation fan 19 in a driven state, the saturated steam derived from the steam generator 24 is fed toward the front portion 18*a* of the circulation duct 18 and the rear portion 2*d*. With the circulation fan 19 in a non-driven state, the saturated steam derived from the steam generator 24 flows out into the heating chamber 2 via a plurality of steam supply ports 37. In addition, the steam supply ports 37 are depicted only one in number in FIG. 3.

The steam tube 36 is attached to the connecting portion 18*b* of the circulation duct 18. The steam tube 36 blows off saturated steam derived from the steam generator 24 to the downstream side of the circulation fan 19 within the circulation duct 18. While the circulation fan 19 is at rest, saturated steam blown off from the steam tube 36 can be let to flow directly into the heating chamber 2 without passing via the upper heater 20, the middle heater 21 and the lower heater 22. That is, a gap is provided between a heating chamber 2-side end of the steam tube 36 and the sloped portion 2*f*, and the steam supply ports 37 opposed to the heating chamber 2-side end of the steam tube 36 are provided in the sloped portion 2*f*.

The saturated steam blown off from the steam tube 36 or the saturated steam within the heating chamber 2 is fed by the circulation fan 19 to the upper heater 20, the middle heater 21 and the lower heater 22, where the saturated steam is heated by the upper heater 20, the middle heater 21 and the lower heater 22 so that the saturated steam can be formed into superheated steam of 100° C. or higher.

In the lid 33, a water level sensor 38 composed of a pair of electrodes 39A, 39B is attached. Based on whether there has arisen an electrical continuity between these electrodes 39A, 39B, it is decided whether or not the water level on the bottom portion of the container 32 has reached a specified level.

The tube pump 25 operates so that a water supply/drain tube 40 made from silicone rubber or the like and elastically deformable is squeezed by a roller (not shown), causing water in the water supply tank 26 to flow to the steam generator 24 or causing the water in the steam generator 24 to flow to the water supply tank 26.

The water supply tank 26 has a water supply tank body 41 and a communicating tube 42. The communicating tube 42 has one end portion positioned within the water supply tank body 41 and the other end portion positioned outside the water supply tank 26. As the water supply tank 26 is accommodated in a tank cover 43, the other end portion of the communicating tube 42 is connected to the water supply/drain tube 40 via a tank joint portion 44. That is, inside of the water supply tank body 41 is communicated with inside of the steam generator 24 via the communicating tube 42 or the like.

Figure 4:
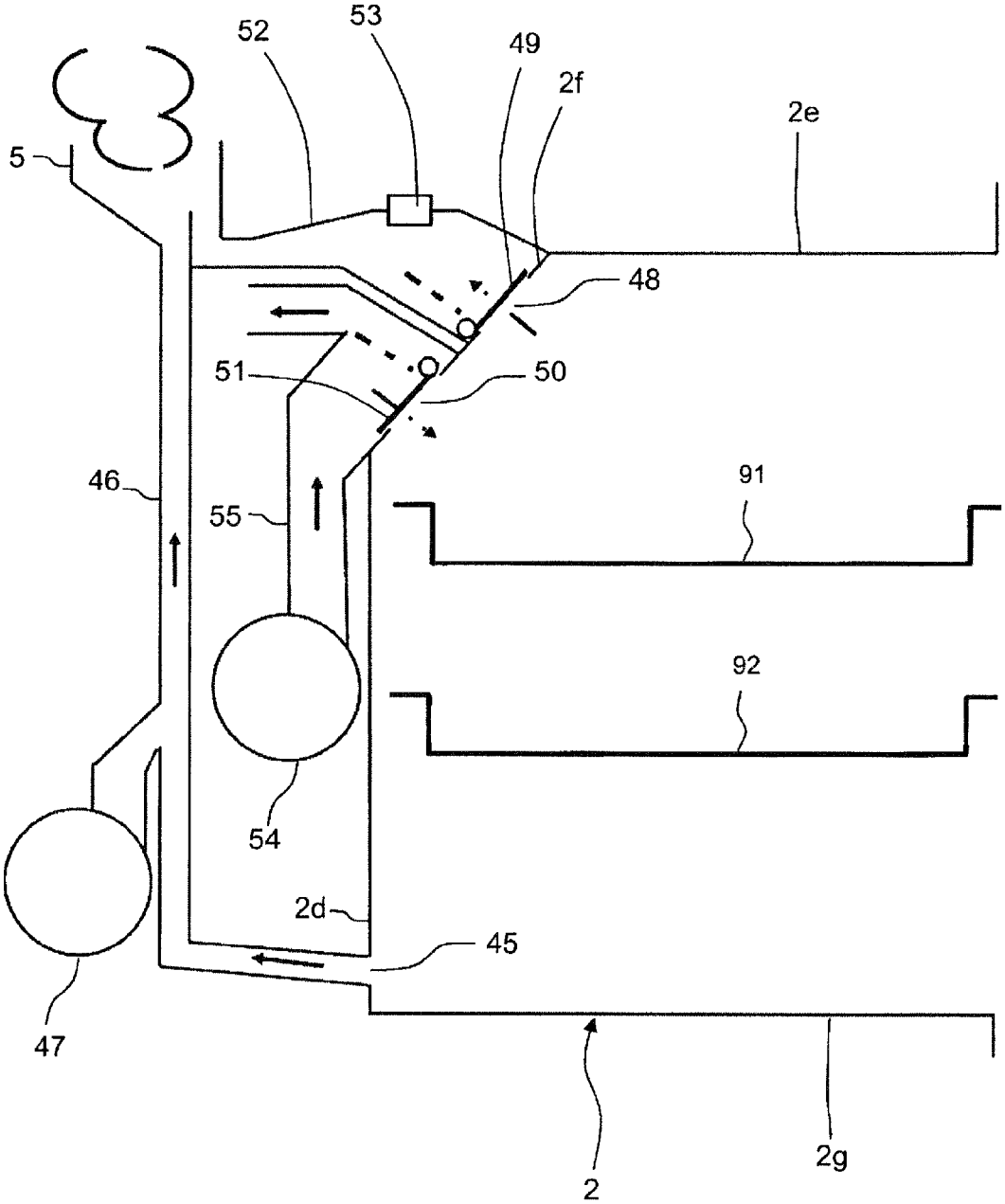
FIG. 4 is a schematic view for explaining other part of the cooking device.

FIG. 4 is a schematic view for explaining a structure of other part of the cooking device. Also in FIG. 4, the heating chamber 2 is shown as viewed from the left side as in FIG. 3.

A natural exhaust port 45 is provided at a lower end portion of the rear portion 2*d* of the heating chamber 2. The natural exhaust port 45 is communicated with an exhaust duct 5 via a first exhaust path 46. When air and the like within the heating chamber 2 has come to an excessive level, excess air or the like naturally flows out through the natural exhaust port 45 to the first exhaust path 46. An exhaust fan 47 provided as a multiblade fan as an example is connected to the first exhaust path 46.

A plurality of forced exhaust ports 48 to be opened and closed by an exhaust damper 49 as well as a plurality of air supply ports 50 to be opened and closed by an air supply damper 51 are provided in the sloped portion 2*f* of the heating chamber 2. These forced exhaust ports 48 are communicated with the exhaust duct 5 via a second exhaust path 52. Meanwhile, the air supply ports 50 are communicated with a space between the casing 1 and the heating chamber 2 via an air supply path. An air supply fan 54 provided as a multiblade fan as an example is connected to an air supply path 55. The forced exhaust ports 48 and the air supply ports 50 are depicted each only one in number exaggeratedly largely in FIG. 4.

A steam sensor 53 is attached on the second exhaust path 52. The steam sensor 53 delivers a signal indicative of a steam level flowing through the second exhaust path 52 to a control unit 100 (shown in FIG. 5).

For forced exhaust of air and the like from within the heating chamber 2 out of the casing 1, the exhaust damper 49 and the air supply damper 51 are pivoted to positions indicated by two-dot chain line by an exhaust damper motor 60 and an air-supply-damper motor 61 (shown in FIG. 5), respectively. That is, the exhaust damper 49 and the air supply damper 51 are opened. Then, the exhaust fan 47 and the air supply fan 54 are driven by an exhaust fan motor 57 and an air-supply-fan motor 58 (shown in FIG. 5). As a result of this, air and the like within the heating chamber 2 are drawn out of the heating chamber 2 through the forced exhaust ports 48 and the natural exhaust port 45.

For cooling of the magnetron 4 or the like between the casing 1 and the heating chamber 2, the air supply fan 54 is driven with the air supply damper 51 closed. As a result of this, air blown off from the air supply fan 54 is supplied to the space between the casing 1 and the heating chamber 2 via the air supply path 55.

Figure 5:
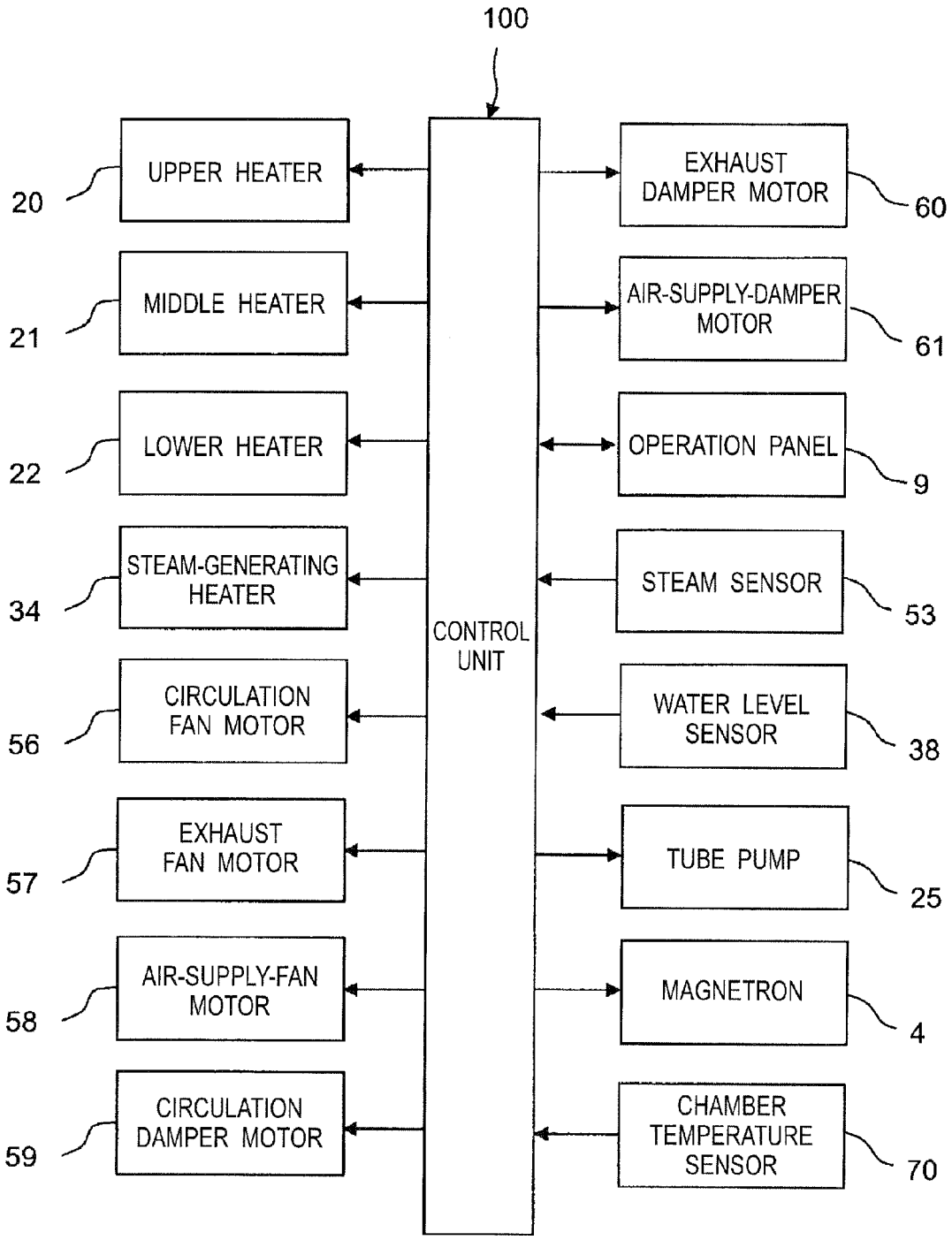
FIG. 5 is a control block diagram of the cooking device.

FIG. 5 is a control block diagram of the cooking device.

The cooking device includes a control unit 100 composed of a microcomputer, input/output circuits, and the like. Connected to the control unit 100 are the upper heater 20, the middle heater 21, the lower heater 22, the steam-generating heater 34, the circulation fan motor 56, the exhaust fan motor 57, the air-supply-fan motor 58, the circulation damper motor 59, the exhaust damper motor 60, the air-supply-damper motor 61, the operation panel 9, the steam sensor 53, the water level sensor 38, the tube pump 25, the magnetron 4, a chamber temperature sensor 70, and the like. Based on signals derived from the operation panel 9, the steam sensor 53, the water level sensor 38, the chamber temperature sensor 70 and the like, the control unit 100 controls the upper heater 20, the middle heater 21, the lower heater 22, the steam-generating heater 34, the circulation fan motor 56, the exhaust fan motor 57, the air-supply-fan motor 58, the circulation damper motor 59, the exhaust damper motor 60, the air-supply-damper motor 61, the tube pump 25, and the like.

The chamber temperature sensor 70 is a sensor for detecting a temperature inside the heating chamber 2. The chamber temperature sensor 70 is placed near the circulation fan 19 to detect a temperature inside the connecting portion 18*b* of the circulation duct 18. A temperature inside the connecting portion 18*b* of the circulation duct 18 becomes generally equal to a temperature inside the heating chamber 2 due to the drive of the circulation fan 19.

Figure 6:
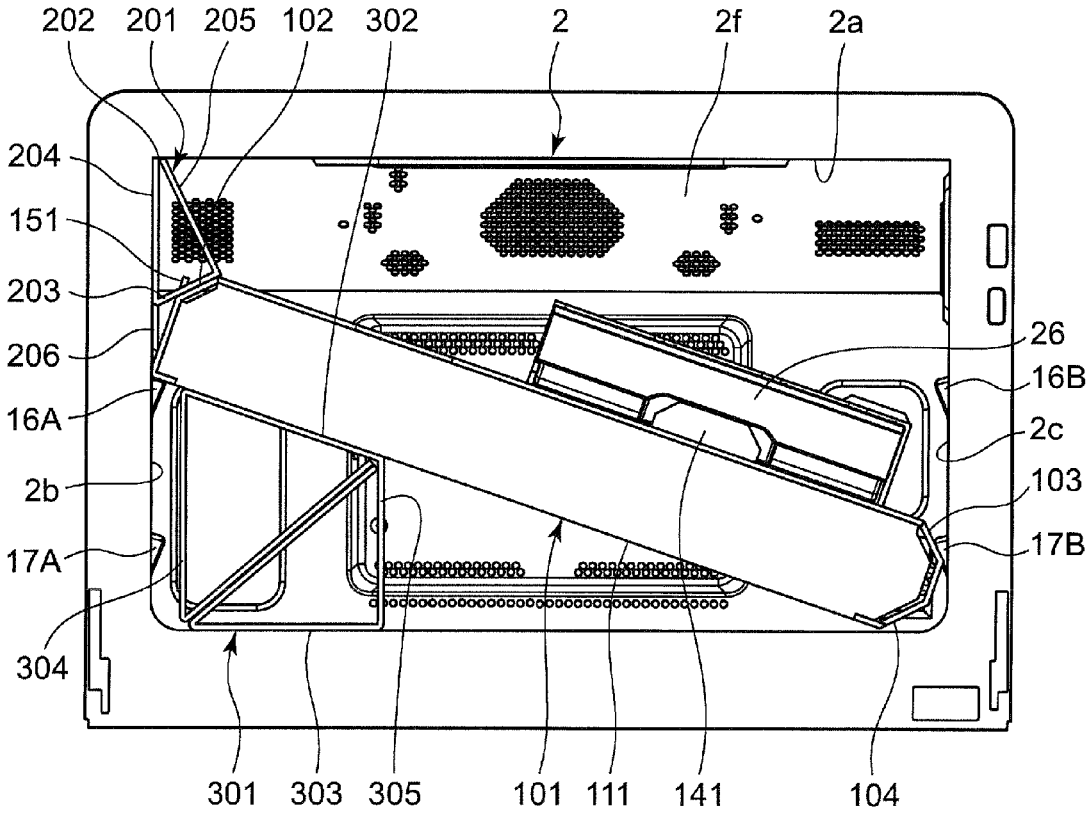
FIG. 6 is a schematic appearance view of a heating chamber and its interior of the cooking device as viewed from the front side.
Figure 7:
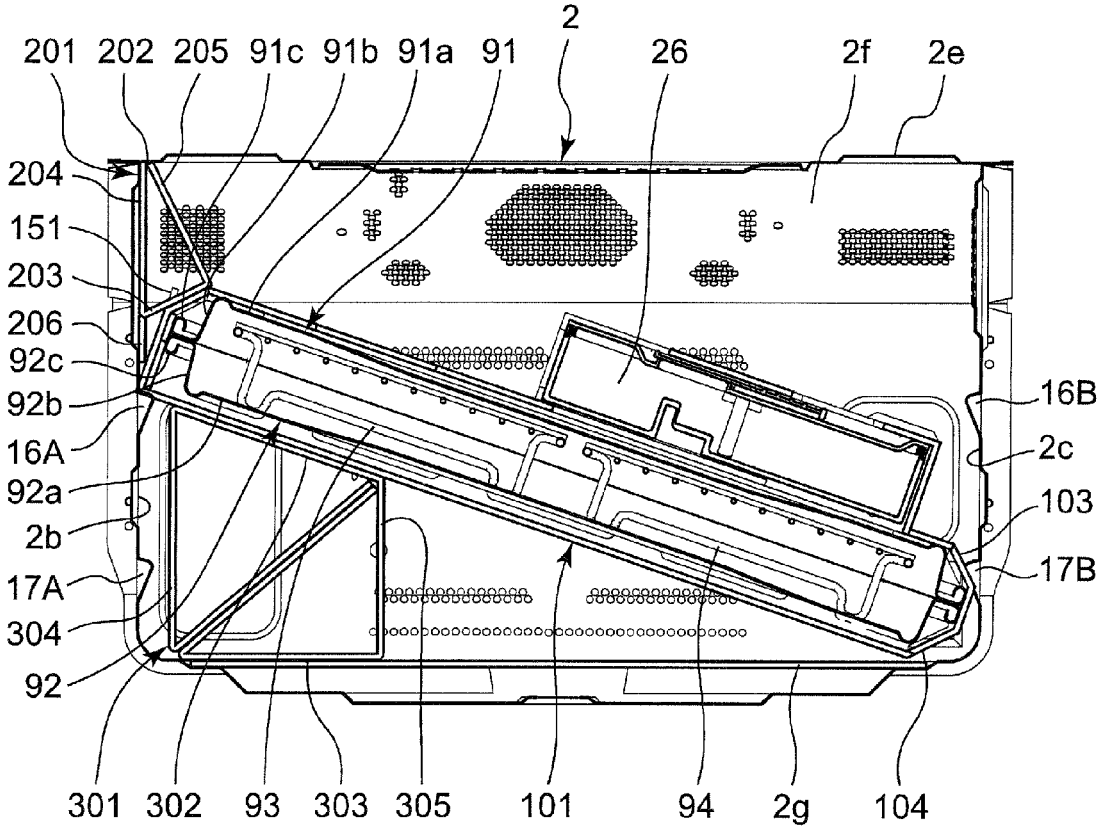
FIG. 7 is a schematic sectional view of the heating chamber and its interior as viewed from the front side.

FIG. 6 is a schematic appearance view of the heating chamber 2 and its interior as viewed from the front side, for transportation of the cooking device. FIG. 7 is a schematic sectional view of the heating chamber 2 and its interior as viewed from the front side.

As shown in FIGS. 6 and 7, this cooking-device packaging structure includes a box-shaped packaging material 101, and first, second cushioning materials 201, 301. The first cushioning material 201 is an example of the cushioning material.

The packaging material 101, which is formed by bending corrugated cardboard having a specified shape, packages the cooking trays 91, 92. In this packaging material 101, the cooking tray 91 is superposed on the cooking tray 92. More specifically, the cooking tray 91 is packaged by the packaging material 101 so that its bottom portion 91*a* is opposed to the upper portion 2*e* of the heating chamber 2, where the bottom portion 91*a* is positioned above the flange portion 91*c*. The cooking tray 92, on the other hand, is packaged by the packaging material 101 so that its bottom portion 92*a* is opposed to a bottom portion 2*g* of the heating chamber 2, where the bottom portion 92*a* is positioned below the flange portion 92*c*.

Between the bottom portion 91*a* of the cooking tray 91 and the bottom portion 92*a* of the cooking tray 92, cooking grids 93, 94 are accommodated so as to be neighboring each other in the left-right direction. These cooking grids 93, 94 are wrapped with vinyl (not shown), being kept from contact with the cooking trays 91, 92.

The packaging material 101 is disposed in the heating chamber 2 with such an inclination that a left side portion of the packaging material 101 becomes higher than a right side portion of the packaging material 101. In this case, the left side portion of the packaging material 101 is placed on first upper tray holder 16A while the right side portion of the packaging material 101 is placed on the bottom portion 2*g* of the heating chamber 2. The first cushioning material 201 is inserted between the upper portion 2*e* of the heating chamber 2 and the left side portion of the packaging material 101 so that the left side portion of the packaging material 101 is pressed against the first upper tray holder 16A while the right side portion of the packaging material 101 is pressed against the chamber inner side surface 2*c*. In addition, the left side portion of the packaging material 101 is an example of the one side portion of the packaging material 101. The right side portion of the packaging material 101 is an example of the other side portion of the packaging material.

At an upper-side corner portion of the left side portion of the packaging material 101, a first chamfered surface 102 is provided so that part of the first cushioning material 201 is to be put into contact therewith. The first chamfered surface 102 is positioned near a plane which is in contact with the left end of the bottom portion 91*a* of the cooking tray 91 as well as in contact with the left end of the flange portion 91*c* of the cooking tray 91. In this case, the left end of the bottom portion 91*a* of the cooking tray 91 is positioned near an upper end of the first chamfered surface 102. Meanwhile, the left end of the flange portion 91*c* of the cooking tray 91 is positioned near a lower end of the first chamfered surface 102. In addition, no chamfered surface is provided at the lower-side corner portion of the left side portion of the packaging material 101. That is, the lower-side corner portion of the left side portion of the packaging material 101 is formed so as to have a generally right angle.

The right side portion of the packaging material 101 is disposed between the second lower tray holder 17B and the bottom portion 2*g* of the heating chamber 2. At an upper-side corner portion of the right side portion of the packaging material 101, a second chamfered surface 103 with which the second lower tray holder 17B is to be put into contact is provided. Meanwhile, a third chamfered surface 104 is provided at the lower-side corner portion of the right side portion of the packaging material 101. The third chamfered surface 104 has a gap against the bottom portion 2*g* of the heating chamber 2.

The first cushioning material 201 is formed by bending corrugated cardboard having a specified shape. The first cushioning material 201 has such a generally triangular-shaped cross section that its top portion 202 is in contact with the upper portion 2*e* of the heating chamber 2 while its bottom portion 203 is in contact with the first chamfered surface 102. A tip end portion of a left side portion of the bottom portion 203 ranging from its left end and a tip end portion of a right side portion 205 of a bottom portion 201*b* ranging from its right end form the top portion 202. Also, a tip end portion of a left side portion 204 of the bottom portion 203 ranging from its left end is not bonded to a tip end portion of the right side portion 205 ranging from the right end of the bottom portion 203. That is, the tip end portion of the right side portion 205 ranging from the right end of the bottom portion 201*b* can be set apart from the tip end portion of the left side portion 204 ranging from the left end of the bottom portion 201*b*.

The first cushioning material 201 also has an engagement piece 206 ranging from the lower end of the left side portion 204. The engagement piece 206 is disposed between the left side portion of the packaging material 101 and the left-side inner side surface 2*b* of the heating chamber 2 so as to be engaged with the left side portion of the packaging material 101 and moreover engaged with the left-side inner side surface 2*b* of the heating chamber 2. In addition, the engagement piece 206 is an example of the engagement portion.

The second cushioning material 301 having a generally trapezoidal cross-sectional shape is inserted between the bottom portion 2*g* of the heating chamber 2 and the left side portion of the packaging material 101. The second cushioning material 301 is formed also by bending corrugated cardboard having a specified shape, as in the first cushioning material 201. The second cushioning material 301 has an upper portion 302 to be put into contact with a bottom portion 111 of the packaging material 101 and a bottom portion 303 to be put into contact with the bottom portion 2*g* of the heating chamber 2. The second cushioning material 301 also has a left side portion 304 and a right side portion 305 extending generally parallel to the left side portion 304. A gap is formed between the left side portion 304 and the chamber inner side surface 2*b*.

Figure 8:
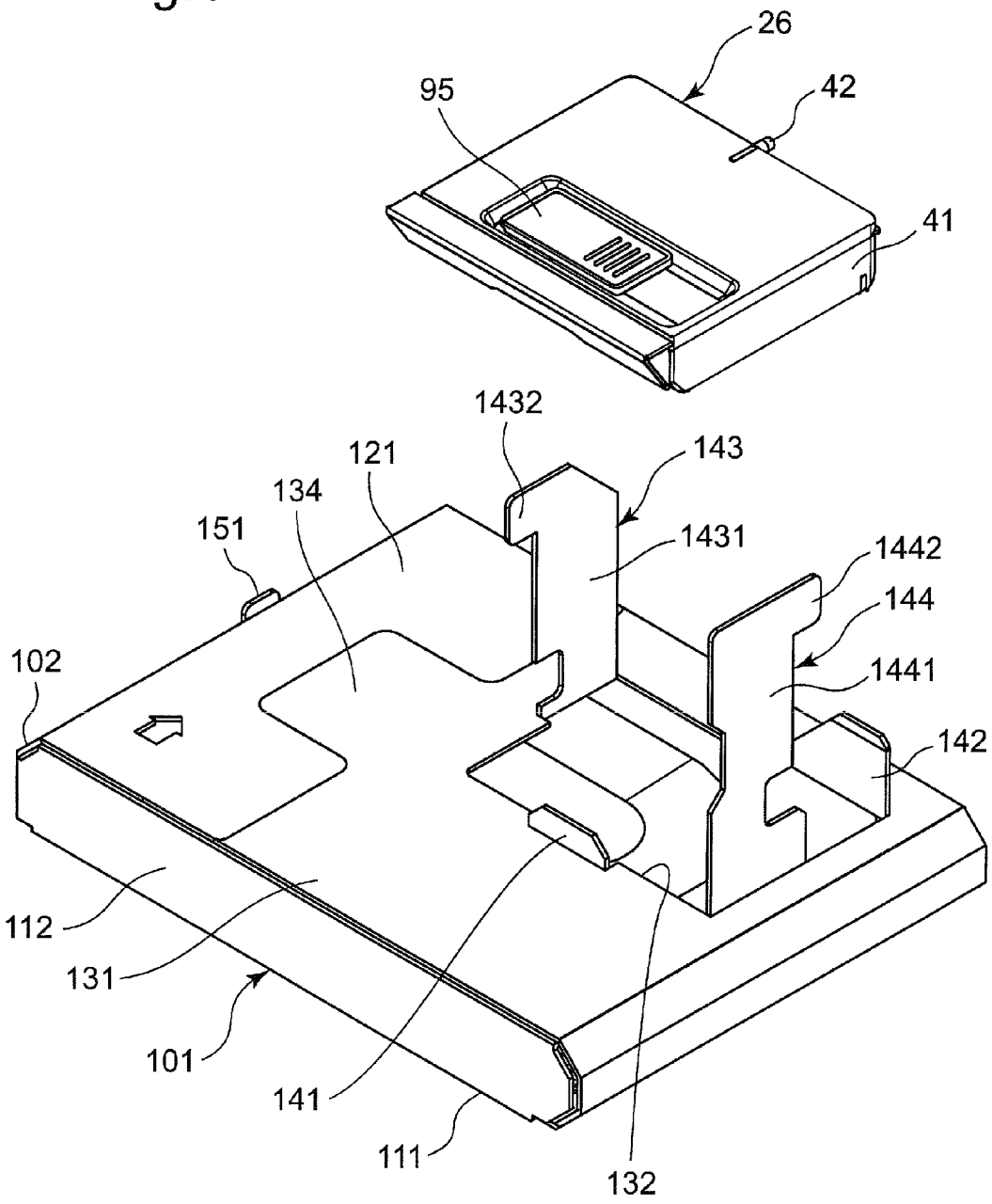
FIG. 8 is a schematic perspective view of a packaging material of the cooking-device packaging structure and a water supply tank of the cooking device.
Figure 9:
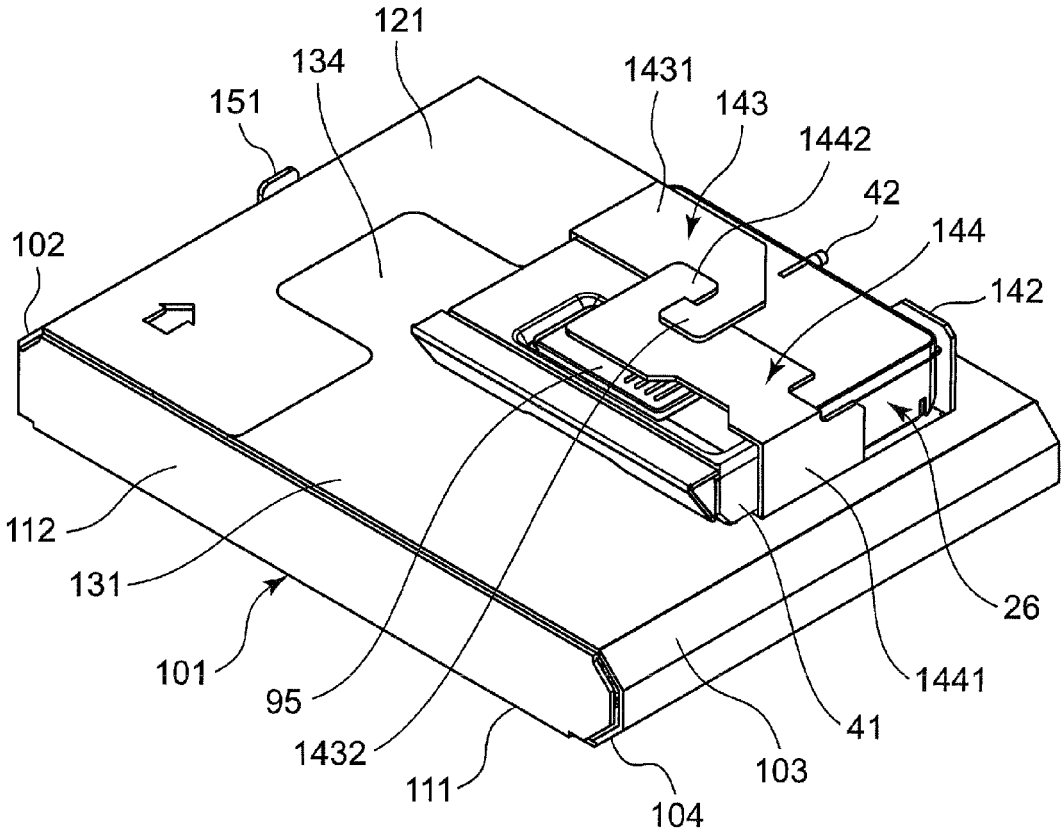
FIG. 9 is a schematic perspective view of the packaging material of the cooking-device packaging structure and the water supply tank of the cooking device.
Figure 10:
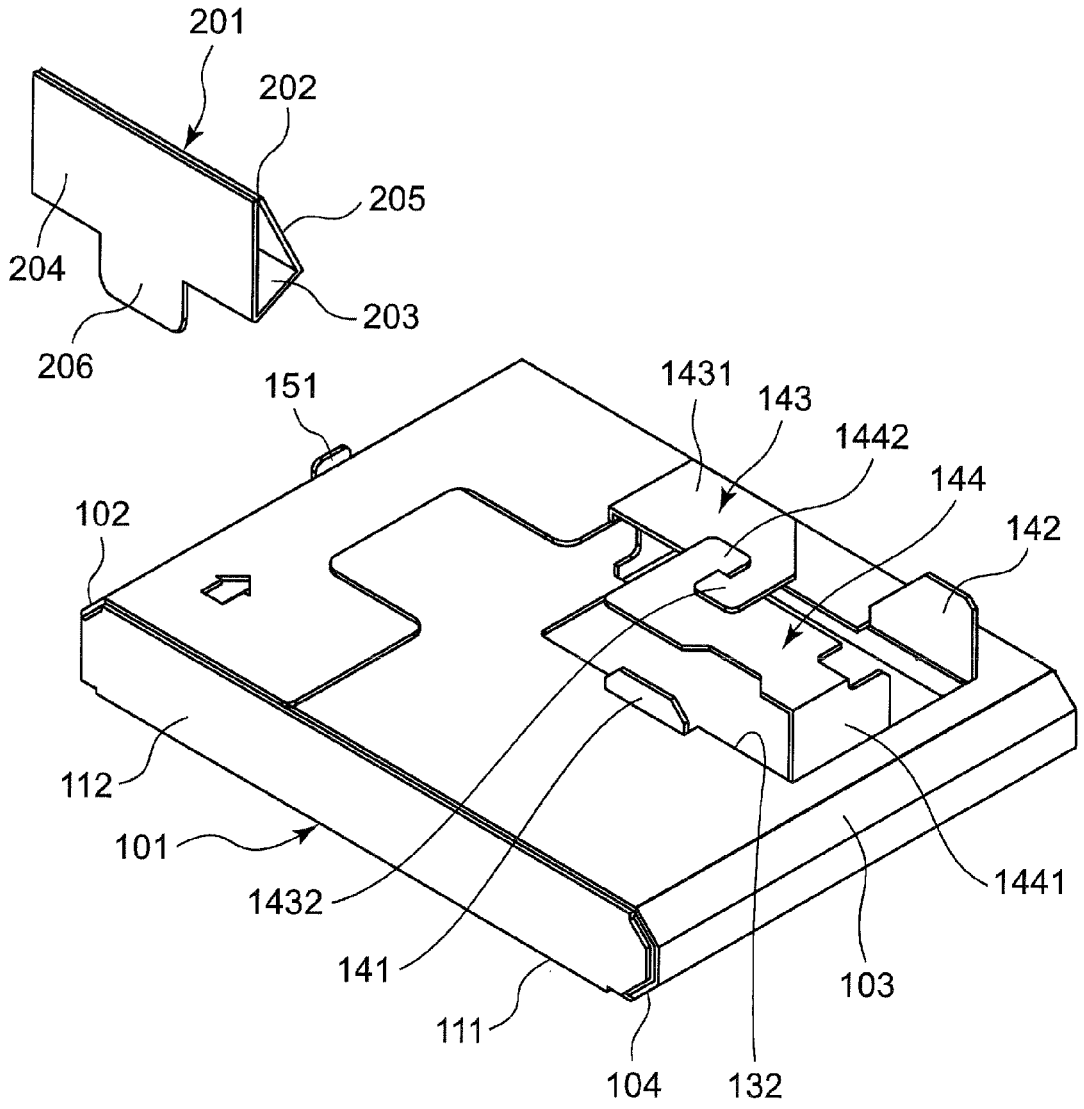
FIG. 10 is a schematic perspective view of the packaging material of the cooking-device packaging structure and a first cushioning material.

The packaging material 101 holds the water supply tank 26 so as to prevent the water supply tank 26 from making contact with the heating chamber 2. When the packaging material 101 is inserted into the heating chamber 2, the water supply tank 26 is sandwiched by a front cut-and-raised portion 141 and a rear cut-and-raised portion 142 and moreover held by mutually engaged left arm portion 143 and right arm portion 144 so that the water supply tank 26 is positioned on a deeper side in the heating chamber 2. More specifically, as shown in FIGS. 8 to 10, the packaging material 101 has a first upper flap 121 and a second upper flap 131 to be superposed on an outer side of the first upper flap 121. The second upper flap 131 is provided with an opening 132 to be covered with the water supply tank 26. When the first upper flap 121 and the second upper flap 131 are disposed on the bottom portion 91*a* of the cooking tray 91, part of the bottom portion 91*a* of the cooking tray 91 is exposed from the opening 132. In a way that the exposed part is covered, the water supply tank 26 is mounted on the packaging material 101. In peripheral edge portion of the opening 132, the front cut-and-raised portion 141, the rear cut-and-raised portion 142, the left arm portion 143 and the right arm portion 144 are provided so as to neighbor one another. That is, the front cut-and-raised portion 141, the rear cut-and-raised portion 142, the left arm portion 143 and the right arm portion 144 are provided on the top surface of the packaging material 101. The front cut-and-raised portion 141 and the rear cut-and-raised portion 142 are pivotable in parallel to an insertional direction in which the packaging material 101 is inserted into the heating chamber 2. In other words, the front cut-and-raised portion 141 and the rear cut-and-raised portion 142 are independently pivotable, where pivotal axes of the front cut-and-raised portion 141 and the rear cut-and-raised portion 142 are each perpendicular to the insertional direction of the packaging material 101 into the heating chamber 2. Also, the left arm portion 143 and the right arm portion 144 are engageable with each other. The left arm portion 143 and the right arm portion 144 are independently pivotable, where pivotal axes of the left arm portion 143 and the right arm portion 144 are each parallel to the insertional direction of the packaging material 101 into the heating chamber 2. In addition, the front cut-and-raised portion 141 and the rear cut-and-raised portion 142 are an example of the pair of first cut-and-raises. The left arm portion 143 and the right arm portion 144 are an example of the pair of second cut-and-raises.

The front cut-and-raised portion 141 is fittable into a recessed portion of the front face of the water supply tank 26 to restrict forward movement of the water supply tank 26. The height of the front cut-and-raised portion 141 is set to generally half the height of the water supply tank 26. In addition, the recessed portion is intended to form a grip portion of the water supply tank 26.

The rear cut-and-raised portion 142 is put into contact with the rear/front face of the water supply tank 26 to restrict forward movement of the water supply tank 26. The rear cut-and-raised portion 142 is formed so as to be larger in height and width than the front cut-and-raised portion 141.

The left arm portion 143 has an arm portion body 1431 and a hook portion 1432 projecting forward from a tip end portion of the arm portion body 1431. The left arm portion 143 is formed contactable with the left side face and the top face of the water supply tank 26 to restrict leftward and upward movement of the water supply tank 26.

The right arm portion 144 has an arm portion body 1441 and a hook portion 1442 projecting rearward from the arm portion body 1441. The right arm portion 144 is formed contactable with the right side face and the top face of the water supply tank 26 to restrict rightward and upward movement of the water supply tank 26.

By setting the hook portion 1432 of the left arm portion 143 and the hook portion 1442 of the right arm portion 144 hooked to each other, the left arm portion 143 and the right arm portion 144 become unopenable. That is, it is made possible to maintain a state in which the left arm portion 143 is linked with the right arm portion 144.

The opening 132 is formed so that its opening area becomes smaller than a bottom face area of the water supply tank 26. As a result of this, the peripheral edge portion of the opening 132 supports the water supply tank 26, preventing the bottom face of the water supply tank 26 from making contact with part of the bottom portion 91*a* of the cooking tray 91 exposed from the opening 132.

The water supply tank 26 has a slide plate 95 slidably attached to the water supply tank body 41. The slide plate 95 covers a water supply port (not shown) communicated with a space inside the water supply tank body 41.

The packaging material 101 has a positioning portion 151 which is provided rearward of a front-rear center of the packaging material 101 and which is to be put into contact with a rear end portion of the first cushioning material 201.

Figure 11:
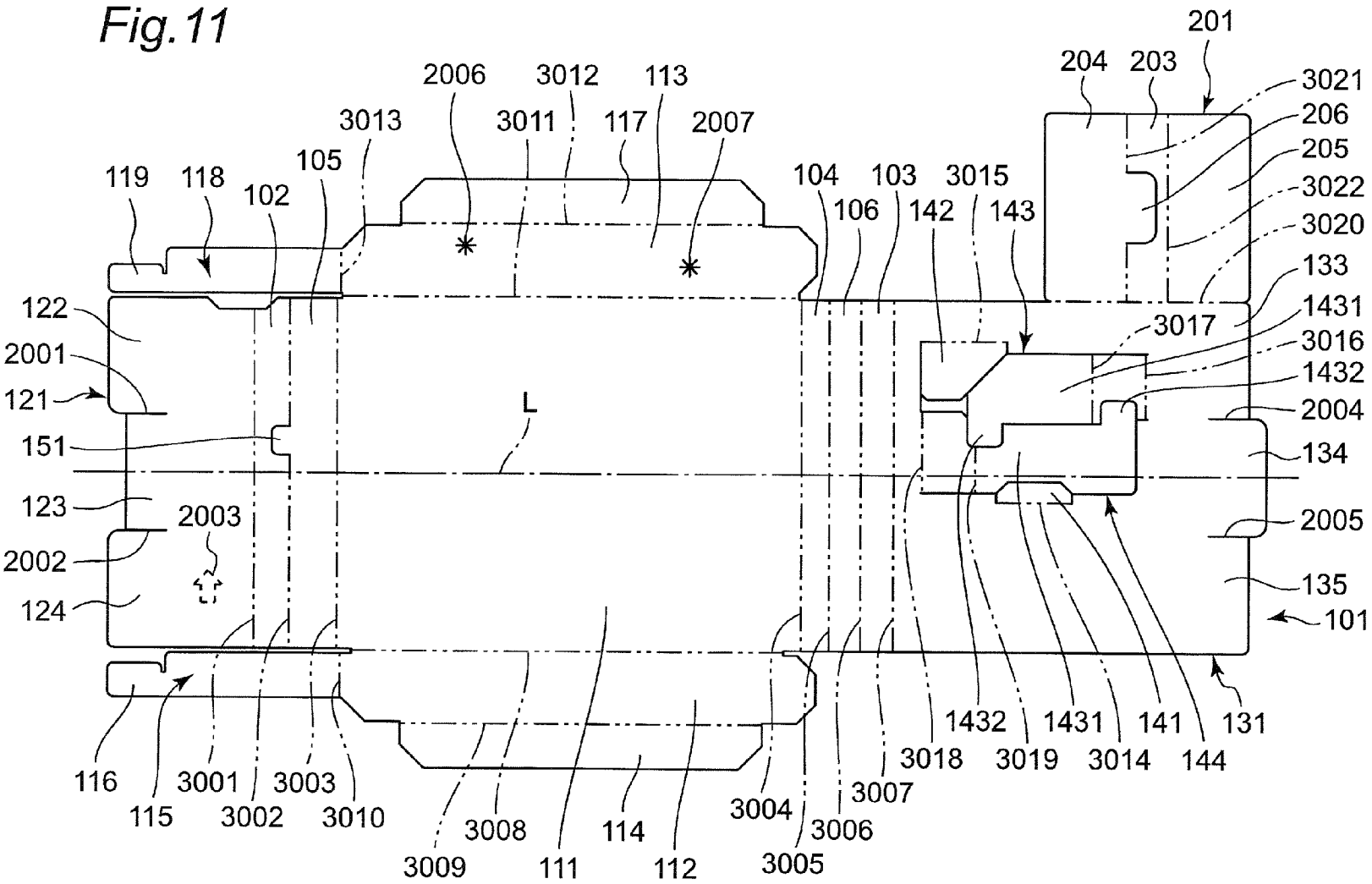
FIG. 11 is a schematic development view of the packaging material and the first cushioning material.

FIG. 11 is a schematic development view of the packaging material 101 and the first cushioning material 201.

In the first upper flap 121, cuts-in 2001, 2002 are formed at end portions on the side opposite to the first chamfered surface 102 side, so that a first left overlap portion 122, a second left overlap portion 123 and a third left overlap portion 124 are formed. These first, third left overlap portions 122, 124 protrude leftward as in the figure more than the second left overlap portion 123. A through hole 2003 having an arrow-shaped perimetrical shape is provided in the first upper flap 121. This arrow indicates the insertional direction of the packaging material 101. With this arrangement, it is less likely that the packaging material 101 may be mis-oriented in the heating chamber 2.

A left side face 105 is provided on one side of the first chamfered surface 102 opposite to the first upper flap 121 side.

Also in the second upper flap 131, cuts-in are formed at end portions on the side opposite to the second chamfered surface 103 side, so that a first right overlap portion 133, a second right overlap portion 134 and a third right overlap portion 135 are formed. The second right overlap portion 134 protrudes rightward as in the figure more than the first, third right overlap portions 133, 135.

A right side face 106 is provided between the second chamfered surface 103 and the third chamfered surface 104.

When the packaging material 101 is bent in specified directions along bending lines 3001-3007, the first, third left overlap portions 122, 124 overlap on the first, third right overlap portions 133, 135 while the second right overlap portion 134 overlaps on the second left overlap portion 123. As a result of this, the first, third left overlap portions 122, 124 sandwiches the second right overlap portion 134, so that the first upper flap 121 and the second upper flap 131 become unopenable.

The packaging material 101 also has a front face portion 112 adjacently ranging from a front edge of the bottom portion 111, and a rear face portion 113 adjacently ranging from a rear edge of the bottom portion 111.

A third upper flap 114 ranges adjacently from an upper edge of the front face portion 112. The third upper flap 114 is bent inward along a bending line 3009. A first inner wall portion 116 ranges adjacently from a left edge of the front face portion 112. At a tip end portion of the first inner wall portion 115, a hook portion 116 narrower in width than the other portion of the first inner wall portion 115 is provided.

A fourth upper flap 117 ranges adjacently from an upper edge of the rear face portion 113. The fourth upper flap 117 is bent along a bending line 3012. A second inner wall portion 118 ranges adjacently from a left edge of the rear face portion 113. At a tip end portion of the second inner wall portion 118, a hook portion 119 narrower in width than the other portion of the second inner wall portion 118 is provided.

Cuts-in 2006, 2007 each having an asterisk-like shape are formed in the rear face portion 113. When the packaging material 101 is set in the heating chamber 2, the protrusions provided in the rear portion 2*d* of the heating chamber 2 fit into the cuts-in 2006, 2007.

When the packaging material 101 is bent in specified directions along bending lines 3008, 3010, 3011, 3013, the hook portion 116 is positioned on the hook portion 119 so that the hook portions 116, 119 are hooked to each other. Thereafter, when the packaging material 101 is bent in specified directions along the bending lines 3001-3003, the first chamfered surface 102 is positioned on the first, second inner wall portions 115, 118. That is, portion of the packaging material 101 where the first chamfered surface 102 is formed is superposed on the first, second inner wall portions 115, 118. As a result of this, the portion of the packaging material 101 causes the first inner wall portion 115 to be pressed against the second inner wall portion 118, making it less likely that hooking of the hook portions 116, 119 is released. The portion of the packaging material 101 can be supported by the first, second inner wall portions 115, 118, thus being less deformable.

Bending the packaging material 101 in specified directions along bending lines 3014-3019 yields the front cut-and-raised portion 141, the rear cut-and-raised portion 142, the left arm portion 143 and the right arm portion 144.

For obtainment of the first cushioning material 201, the packaging material 101 is cut along a cutting line 3020 and moreover bent in a specified direction along a bending line 3022. In this case, an end portion of the left side portion 204 on one side opposite to the bottom portion 203 side is not bonded to an end portion of the right side portion 205 on one side opposite to the bottom portion 203 side. As a result of this, the first cushioning material 201 is enabled to form a cross-sectional shape other than a generally triangular cross-sectional shape before the insertion into the heating chamber 2. That is, the first cushioning material 201 is deformable before the insertion into the heating chamber 2.

It is noted that the reference sign 'L' indicates a center line passing through a front-rear center of the bottom portion 111 of the packaging material 101.

Figure 12:
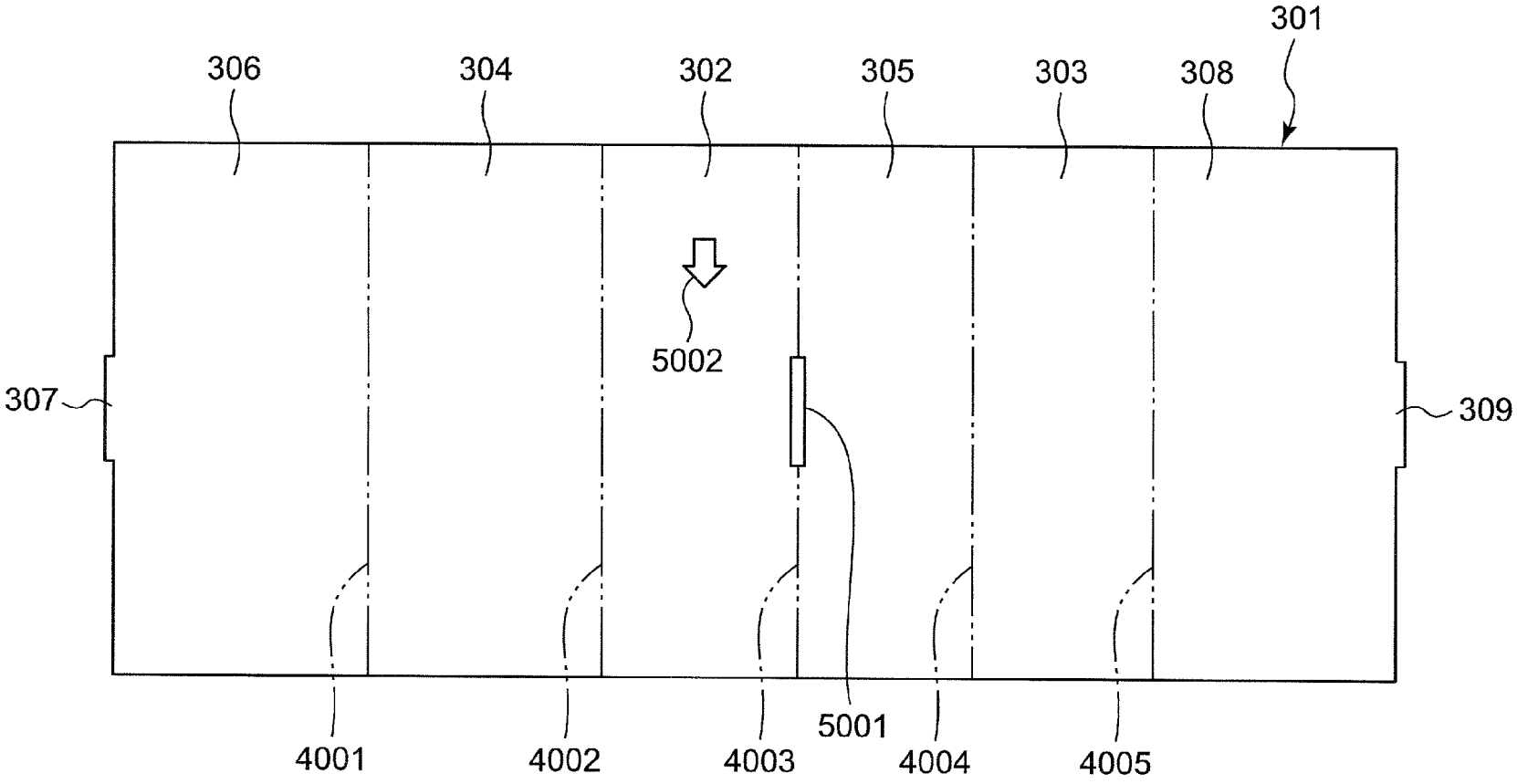
FIG. 12 is a schematic development view of a second cushioning material of the cooking-device packaging structure.

FIG. 12 is a schematic development view of the second cushioning material 301.

The second cushioning material 301 has a first diagonal portion 306 on one side of the left side portion 304 opposite to its upper portion 302 side. At an edge of the first diagonal portion 306 on one side opposite to the left side portion 304 side, a first protruding portion 307 having a generally rectangular shape in a plan view is provided so as to overlap on a front-rear center of the second cushioning material 301.

The second cushioning material 301 also has a second diagonal portion 308 on one side of the bottom portion 303 opposite to the right side portion 305 side. At an edge of the second diagonal portion 308 on one side opposite to the bottom portion 303 side, a second protruding portion 309 having a generally rectangular shape in a plan view is provided. When the second cushioning material 301 is bent in specified directions along bending lines 4001-4005, a generally entirety of the second protruding portion 309 overlaps with a generally entirety of the first protruding portion 307.

Also in the second cushioning material 301, a slot 5001 having a generally rectangular shape in a plan view is provided so as to overlap on a borderline between the bottom portion 303 and the right side portion 305. The firsft, second protruding portions 307, 309 are inserted into the slot 5001. The slot 5001 has a width generally equal to a total thickness of the firsft, second protruding portions 307, 309.

In the upper portion 302 of the second cushioning material 301, a through hole 5002 having an arrow-shaped perimetrical shape is provided. This arrow indicates the insertional direction of the second cushioning material 301. With this arrangement, it is less likely that the second cushioning material 301 may be mis-oriented in the heating chamber 2.

When the second cushioning material 301 is bent along the bending lines 4001-4005, the first, second diagonal portions 306, 308 overlap with diagonal lines of the second cushioning material 301, enhancing the strength of the second cushioning material 301.

According to the cooking-device packaging structure having the above-described constitution, the left side portion of the packaging material 101 is placed on the first upper tray holder 16A, and moreover the right side portion of the packaging material 101 is placed on the bottom portion 2*g* of the heating chamber 2. In this case, the first cushioning material 201 is inserted between the upper portion 2*e* of the heating chamber 2 and the left side portion of the packaging material 101 so that the left side portion of the packaging material 101 is pressed against the first upper tray holder 16A while the right side portion of the packaging material 101 is pressed against the right-side inner side surface 2*c* of the heating chamber 2. As a result of this, vertical and horizontal movement of the packaging material 101 can be restricted. Thus, the possibility that the cooking trays 91, 92 packaged with the packaging material 101 may largely rattle during the transportation can be lowered.

Since the cooking trays 91, 92 are put into the heating chamber 2 as they are packaged with the packaging material 101, the cooking trays 91, 92 can be prevented from wearing during the transportation.

Even if the cooking trays 91, 92 are packaged with the packaging material 101, the packaging material 101 is disposed in the heating chamber 2 with such an inclination that the left side portion of the packaging material 101 becomes higher than the right side portion of the packaging material 101. Therefore, the packaging material 101 can be put into the heating chamber 2 with simplicity and reliability.

Since it is the first chamfered surface 102 of the packaging material 101 that part of the first cushioning material 201 is put into contact with, the first cushioning material 201 can be prevented from being damaged. Therefore, the packaging material 101 can be prevented from rattling during the transportation due to damage to the first cushioning material 201.

Also since it is with the first chamfered surface 102 that part of the first cushioning material 201 is put into contact, the area at which part of the first cushioning material 201 comes into contact with the left side portion of the packaging material 101 can be increased. Therefore, the contact state of part of the first cushioning material 201 becomes stable, the likelihood that the left side portion of the packaging material 101 may rattle during the transportation can be lowered.

Since the first chamfered surface 102 is positioned near a surface which adjoins a left end of the bottom portion 91*a* of the cooking tray 91 and which adjoins a left end of the flange portion 91*c* of the cooking tray 91, the first chamfered surface 102 can be supported by the bottom portion 91*a* and flange portion 91*c* of the cooking tray 91. Therefore, even if part of the first cushioning material 201 is put into contact with the first chamfered surface 102 of the packaging material 101, the first chamfered surface 102 can be prevented from being deformed, so that the packaging material 101 can be prevented from rattling due to deformation of the first chamfered surface 102 during the transportation.

By setting the top portion 202 of the first cushioning material 201 into contact with the upper portion 2*e* of the heating chamber 2 and moreover setting the bottom portion 2*g* of the first cushioning material 201 into contact with the first chamfered surface 102, the left side portion of the packaging material 101 can be pressed against the first upper tray holder 16A with reliability.

Since the cross section of the first cushioning material 201 is formed into a generally triangular shape, the placement space of the first cushioning material 201 can be reduced.

Since the engagement piece 206 is engaged with both the left side portion of the packaging material 101 and the left-side inner side surface 2*b* of the heating chamber 2, the first cushioning material 201 can be prevented from easily separating from the packaging material 101.

The first cushioning material 201 is inserted through the opening 2*a* of the heating chamber 2 to between the upper portion 2*e* of the heating chamber 2 and the left side portion of the packaging material 101. In this case, the rear end portion of the first cushioning material 201 is put into contact with the positioning portion 151, by which the first cushioning material 201 is positioned for a position in the front-rear direction. Therefore, the placement work for the first cushioning material 201 is facilitated.

Since the positioning portion 151 is located rearward of the center line L passing through the front-rear center of the bottom portion 111 of the packaging material 101, an appropriately wide space can be allowed for the placement space of the first cushioning material 201.

Since the right side portion of the packaging material 101 is placed between the second lower tray holder 17B of the right-side inner side surface 2*c* of the heating chamber 2 and the bottom portion 2*g* of the heating chamber 2, the likelihood that the right side portion of the packaging material 101 may rattle during the transportation can be lowered with reliability.

Since it is the second chamfered surface 103 with which the second lower tray holder 17B is put into contact in the packaging material 101, the first cushioning material 201 can be prevented from being damaged. Therefore, the packaging material 101 can be prevented from rattling during the transportation due to damage to the first cushioning material 201.

Also since it is the second chamfered surface 103 with which the second lower tray holder 17B is put into contact, the area at which the second lower tray holder 17B comes into contact with the right side portion of the packaging material 101 can be increased. Therefore, the contact state of the second lower tray holder 17B becomes stable, the likelihood that the right side portion of the packaging material 101 may rattle during the transportation can be lowered.

Even if there have arisen manufacturing errors in the cooking grids 93, 94, the restriction of vertical and horizontal movement of the packaging material 101 by the cooking grids 93, 94 is never adversely affected.

Since the first chamfered surface 102 is positioned near a plane which is in contact with the left end of the bottom portion 91*a* of the cooking tray 91 as well as in contact with the left end of the flange portion 91*c* of the cooking tray 91, the first chamfered surface 102 can be supported by both the bottom portion 91*a* and the flange portion 91*c* of the cooking tray 91. Therefore, even if part of the first cushioning material 201 is put into contact with the first chamfered surface 102 of the packaging material 101, the first chamfered surface 102 can be prevented from being deformed, so that the packaging material 101 can be prevented from rattling due to deformation of the first chamfered surface 102 during the transportation.

By setting the top portion 202 of the first cushioning material 201 into contact with the upper portion of the heating chamber 2 and moreover setting the bottom portion 2*g* of the first cushioning material 201 into contact with the first chamfered surface 102, the left side portion of the packaging material 101 can be pressed against the first upper tray holder 16A with reliability.

The first chamfered surface 102 is provided at an upper-side corner portion of the left side portion of the packaging material 101, and the first cushioning material 201 is formed into a generally triangular-shaped cross section. Also, the left side portion of the packaging material 101 is placed on the first upper tray holder 16A. Therefore, even if manufacturing errors have occurred to the packaging material 101, the space between the upper portion 2*e* of the heating chamber 2 and the left side portion of the packaging material 101 is not largely changed. Thus, with use of the first cushioning material 201, the left side portion of the packaging material 101 can be pressed against the first upper tray holder 16A with reliability.

In the above-described embodiment, the first, second cushioning materials 201, 301 are formed from corrugated cardboard. However, the first, second cushioning materials 201, 301 may be formed from paper other than corrugated cardboard or otherwise from styrene foam or the like.

In the embodiment, the first cushioning material 201 is formed into a generally triangular cross-sectional shape. However, the cross-sectional shape may be, for example, a pentagonal shape.

In the embodiment, the second cushioning material 301 is inserted between the bottom portion 2*g* of the heating chamber 2 and the left side portion of the packaging material 101. However, the second cushioning material 301 may be non-inserted therebetween.

In the embodiment, the engagement piece 206 is made engageable with the left side portion of the packaging material 101 as well as engageable with the left-side inner side surface 2*b* of the heating chamber 2. However, the engagement piece 206 may be engageable with only either one of the left side portion of the packaging material 101 and the left-side inner side surface 2*b* of the heating chamber 2.

Although a specific embodiment of the present invention has been described hereinabove, yet the invention is not limited to the above embodiment and may be carried out as it is changed and modified in various ways within the scope of the invention. For example, any combination between the embodiment and appropriate one or ones of the above-described modifications as required may be taken as one embodiment of the invention.

That is, the present invention and its embodiments can be summarized as described below.

A packaging structure for a cooking device of the invention is a cooking-device packaging structure for transporting a cooking device including: a heating chamber 2 having on a front side an opening 2*a* in which a heating object 15 to be heated is accommodated; trays 91, 92 each for mounting the heating object 15 thereon; and tray holders 16A, 17B provided on inner side surfaces 2*b*, 2*c* of the heating chamber 2 to hold the trays 91, 92, respectively, the cooking-device packaging structure comprising:

a box-shaped packaging material 101 for packaging the trays 91, 92; and a cushioning material 201, wherein the packaging material 101 with the trays 91, 92 packaged therewith is disposed in the heating chamber 2 with such an inclination that a one-side portion of the packaging material 101 becomes higher than the other-side portion of the packaging material 101, the one-side portion of the packaging material 101 is placed on the one-side portion side tray holder 16A, and the cushioning material 201 is inserted between the upper portion of the heating chamber 2 and the one-side portion of the packaging material 101 so that the one-side portion of the packaging material 101 is pressed against the one-side-portion side tray holder 16A while the other-side portion of the packaging material 101 is pressed against the other-side-portion side inner side surface 2*c* of the heating chamber 2.

With this constitution, a one-side portion of the packaging material 101 is placed on the one-side-portion side tray holder 16A. In this case, since the cushioning material 201 is inserted between the upper portion of the heating chamber 2 and the one-side portion of the packaging material 101 so that the one-side portion of the packaging material 101 is pressed against the one-side-portion side tray holder 16A while the other-side portion of the packaging material 101 is pressed against the other-side-portion side inner side surface 2*c* of the heating chamber 2, it is made possible to restrict vertical and horizontal movement of the packaging material 101. Therefore, the likelihood that the trays 91, 92 may largely rattle during transportation can be lowered.

Since the trays 91, 92 are put into the heating chamber 2 as they are packaged with the packaging material 101, the trays 91, 92 can be prevented from wearing during the transportation.

Even with the trays 91, 92 packaged with the packaging material 101, since the packaging material 101 is disposed in the heating chamber 2 with such an inclination that a one-side portion of the packaging material 101 becomes higher than the other-side portion of the packaging material 101, the packaging material 101 can be set into the heating chamber 2 with simplicity and reliability.

In the cooking-device packaging structure of one embodiment, a chamfered surface 102 with which part of the cushioning material 201 is to be put into contact is provided at an upper-side corner portion of the one-side portion of the packaging material 101.

According to this embodiment, since it is the chamfered surface 102 that part of the cushioning material 201 is put into contact with, the area at which part of the cushioning material 201 comes into contact with a one-side portion of the packaging material 101 can be increased. Therefore, the likelihood that the one-side portion of the packaging material 101 may rattle during the transportation can be lowered.

In the cooking-device packaging structure of one embodiment, the tray 91 has a bottom portion 91*a*, a wall portion 91*b* erectly provided at peripheral edge portion of the bottom portion 91*a*, and a flange portion 91*c* that stretches outward in adjacency to an end portion of the wall portion 91*b* on one side opposite to a bottom portion 91*a* side, the bottom portion 91*a* being packaged with the packaging material 101 so that the bottom portion 91*a* is opposed to an upper portion 2*e* of the heating chamber 2, and the chamfered surface 102 is positioned near a plane which is in contact with the one-side-portion side end of the bottom portion 91*a* of the cooking tray 91 as well as in contact with the one-side-portion side end of the flange portion 91*c* of the cooking tray 91.

According to this embodiment, by placing the chamfered surface 102 near a plane which is in contact with a one-side-portion side end of the bottom portion 91*a* of the tray 91 as well as in contact with a one-side-portion side end of the flange portion 91*c* of the tray 91, it is made possible to support the chamfered surface 102 by the bottom portion 91*a* and the flange portion 91*c* of the tray 91. Therefore, even if part of the cushioning material 201 is put into contact with the chamfered surface 102 of the packaging material 101, the chamfered surface 102 can be prevented from being deformed, so that the packaging material 101 can be prevented from rattling due to deformation of the chamfered surface 102 during the transportation.

In the cooking-device packaging structure of one embodiment, the cushioning material 201 has such a generally triangular-shaped cross section that its top portion 202 is in contact with the upper portion 2*e* of the heating chamber while its bottom portion 203 is in contact with the chamfered surface 102.

According to this embodiment, by setting the top portion 202 of the cushioning material 201 into contact with the upper portion 2*e* of the heating chamber 2 and moreover setting the bottom portion 203 of the cushioning material 201 into contact with the chamfered surface 102, a one-side portion of the packaging material 101 can be pressed against the one-side-portion side tray holder 16A with reliability.

Since the cross section of the cushioning material 201 is formed into a generally triangular shape, the placement space of the cushioning material 201 can be reduced.

In the cooking-device packaging structure of one embodiment, the cushioning material 201 has an engagement portion 206 which is placed between the one-side portion of the packaging material 101 and the one-side-portion side inner side surface 2*b* of the chamber and which is to be engaged with at least one of the one-side portion of the packaging material 101 and the one-side-portion side inner side surface 2*b* of the chamber.

According to this embodiment, by setting the engagement portion 206 engaged with at least one of the one-side portion of the packaging material 101 and the one-side-portion side inner side surface 2*b* of the chamber, it becomes less likely that the cushioning material 201 may be separated from the packaging material 101.

In the cooking-device packaging structure of one embodiment, the packaging material 101 has a positioning portion 151 which is provided rearward of a front-rear center of the packaging material 101 and which is to be put into contact with a rear end portion of the cushioning material 201.

According to this embodiment, the cushioning material 201 is inserted through the opening 2*a* of the heating chamber 2 to between the upper portion 2*e* of the heating chamber 2 and a one-side portion of the packaging material 101. In this case, the rear end portion of the cushioning material 201 is put into contact with the positioning portion 151, by which the cushioning material 201 is positioned for a position in the front-rear direction. Therefore, the placement work for the cushioning material 201 is facilitated.

The cushioning material 201 may can placed in a space ranging from the opening 2*a* of the heating compartment 2 to an immediate before the positioning portion 151 of the packaging material 101. Since the positioning portion 151 is located rearward of the front-rear center of the packaging material 101, the placement space for the cushioning material 201 never becomes excessively small.

In the cooking-device packaging structure of one embodiment, the other-side portion of the packaging material 101 is placed between the other-side-portion side tray holder 17B and the bottom portion 2*g* of the heating chamber 2.

According to this embodiment, by placing the other-side portion of the packaging material 101 between the other-side-portion side tray holder 17B and the bottom portion 2*g* of the heating chamber 2, the likelihood that the other-side portion of the packaging material 101 may rattle during the transportation can be lowered with reliability.

In the cooking-device packaging structure of one embodiment, a chamfered surface 103 with which the other-side-portion side tray holder 17B is to be put into contact is provided at an upper-side corner portion of the other-side portion of the packaging material 101.

According to this embodiment, since it is the chamfered surface 103 with which the one-side-portion side tray holder 17B is to be put into contact, the area at which the other-side-portion side tray holder 17B comes into contact with the other-side portion of the packaging material 101 can be increased. Therefore, the likelihood that the other-side portion of the packaging material 101 may rattle during the transportation can be lowered.

In the cooking-device packaging structure of one embodiment, a pair of first cut-and-raises 141, 142 pivotable along a plane parallel to an insertional direction of the packaging material 101 into the heating chamber 2 as well as a pair of mutually engageable second cut-and-raises 143, 144 are provided in a top surface of the packaging material 101, and a water supply tank 26 to be used for the cooking device is sandwiched by the first cut-and-raises 141, 142 while the water supply tank 26 is held by the mutually engaged second cut-and-raises 143, 144.

According to this embodiment, the need for preparing a packaging material only for the water supply tank 26 can be eliminated, and moreover the water supply tank 26 can be prevented from rattling during the transportation.

In the cooking-device packaging structure of one embodiment, the water supply tank 26 is sandwiched by the first cut-and-raises 141, 142 and moreover held by the mutually engaged second cut-and-raises 143, 144 so as to be positioned on a deeper side (rearward side) in the heating chamber 2 when the packaging material 101 is inserted into the heating chamber 2.

According to this embodiment, since the water supply tank 26 is positioned on a deeper side (rearward side) in the heating chamber 2 when the packaging material 101 is inserted into the heating chamber 2, the likelihood that the water supply tank 26 may be damaged due to contact with any other member located on the opening 2*a* side of the heating chamber 2 can be lowered.

REFERENCE SIGNS LIST

2 heating chamber
2*a* opening
2*b*, 2*c* chamber inner side surface
2*g*, 91*a*, 203 bottom portion
2*e* upper portion
16A first upper tray holder
17B second lower tray holder
91, 92 cooking tray
91*b* wall portion
91*c* flange portion
101 packaging material
102 first chamfered surface
103 second chamfered surface
104 third chamfered surface
151 positioning portion
201 first cushioning material
202 top portion
206 engagement piece

The invention claimed is:

1. A cooking-device packaging structure comprising:

a cooking device including a heating chamber having on a front side an opening in which a heating object to be heated is accommodated; a tray for mounting the heating object thereon; and a tray holder provided on an inner side surface of the heating chamber to hold the tray, the cooking-device packaging structure;

a box-shaped packaging material for packaging the tray; and a cushioning material, wherein the packaging material with the tray packaged therewith is disposed in the heating chamber with such an inclination that a one-side portion of the packaging material becomes higher than the other-side portion of the packaging material, the one-side portion of the packaging material is placed on a one-side portion side tray holder, and the cushioning material is inserted between an upper portion of the heating chamber and the one-side portion of the packaging material so that the one-side portion of the packaging material is pressed against the one-side-portion side tray holder while an other-side portion of the packaging material is pressed against an other-side-portion side inner side surface of the heating chamber.

2. The cooking-device packaging structure as claimed in claim 1, wherein a chamfered surface with which part of the cushioning material is to be put into contact is provided at an upper-side corner portion of the one-side portion of the packaging material.

3. The cooking-device packaging structure as claimed in claim 2, wherein the tray has a bottom portion, a wall portion erectly provided at peripheral edge portion of the bottom portion, and a flange portion that stretches outward in adjacency to an end portion of the wall portion on one side opposite to a bottom portion side, the bottom portion being packaged with the packaging material so that the bottom portion is opposed to an upper portion of the heating chamber, and the chamfered surface is positioned near a plane which is in contact with a one-side-portion side end of the bottom portion of the tray as well as in contact with a one-side-portion side end of the flange portion of the tray.

4. The cooking-device packaging structure as claimed in claim 2, wherein the cushioning material has such a generally triangular-shaped cross section that its top portion is in contact with an upper portion of the heating chamber while its bottom portion is in contact with the chamfered surface.

5. The cooking-device packaging structure as claimed in claim 1, wherein the cushioning material has an engagement portion which is placed between the one-side portion of the packaging material and a one-side-portion side inner side surface of the heating chamber and which is to be engaged with at least one of the one-side portion of the packaging material and the one-side-portion side inner side surface of the heating chamber.

6. The cooking-device packaging structure as claimed in claim 1, wherein the packaging material has a positioning portion which is provided rearward of a front-rear center of the packaging material and which is to be put into contact with a rear end portion of the cushioning material.

7. The cooking-device packaging structure as claimed in claim 1, wherein the other-side portion of the packaging material is placed between the other-side-portion side tray holder and the bottom portion of the heating chamber.

8. The cooking-device packaging structure as claimed in claim 7, wherein a chamfered surface with which the other-side-portion side tray holder is to be put into contact is provided at an upper-side corner portion of the other-side portion of the packaging material.

9. The cooking-device packaging structure as claimed in claim 1, wherein a pair of first cut-and-raises pivotable along a plane parallel to an insertional direction of the packaging material into the heating chamber as well as a pair of mutually engageable second cut-and-raises are provided in a top surface of the packaging material, and a water supply tank to be used for the cooking device is sandwiched by the first cut-and-raises while the water supply tank is held by the mutually engaged second cut-and-raises.

10. The cooking-device packaging structure as claimed in claim 9, wherein the water supply tank is sandwiched by the first cut-and-raises and moreover held by the mutually engaged second cut-and-raises so as to be positioned on a deeper side in the heating chamber when the packaging material is inserted into the heating chamber.

* * * * *